US005873959A

United States Patent [19]

Schurko et al.

[11] Patent Number: 5,873,959

[45] Date of Patent: Feb. 23, 1999

[54] ADAPTIVE CONTROL FOR REHEAT FURNACE

[75] Inventors: Robert J. Schurko, Pittsburgh; Frank G. Spennati, Aliquippa, both of Pa.

[73] Assignee: Techint Technologies Inc., Coraopolis, Pa.

[21] Appl. No.: 128,051

[22] Filed: Sep. 28, 1993

Related U.S. Application Data

[63] Continuation of Ser. No. 742,770, Aug. 9, 1991, abandoned.

[51] Int. Cl.[6] ..... C21D 1/54

[52] U.S. Cl. ..... 148/511; 266/87

[58] Field of Search ..... 148/511; 266/87

[56] References Cited

U.S. PATENT DOCUMENTS 3,868,094 2/1975 Hovis ..... 266/87
4,606,529 8/1986 Tooch ..... 148/511

OTHER PUBLICATIONS

"Automatic slab heating control at Inland's 80–in. hot strip mill", Timothy A. Veslocki et al., AISE Year Book, Dec. 1986, pp. 577–584.

*Primary Examiner*—Scott Kastler
*Attorney, Agent, or Firm*—Webb Ziesenheim Bruening Logsdon Orkin & Hanson, P.C.

[57] ABSTRACT

A method of controlling a reheat furnace to deliver pieces at an aim discharge temperature comprises the steps of determining the ratio between calculated reheat furnace discharge temperatures and measured temperatures of pieces in a rolling mill receiving the output of the reheat furnace, filtering this ratio based upon time in the rolling mill to provide the current filtered relationship between calculated discharge temperatures and said measured temperatures to provide filtered ratios, comparing desired temperatures in the rolling mill with said measured temperatures of pieces in the rolling mill to establish error values, filtering the error values based upon time in the mill to provide filtered error values, and processing the filtered error values and the filtered ratios to establish a short-term bias to the aim extract temperature.

17 Claims, 3 Drawing Sheets

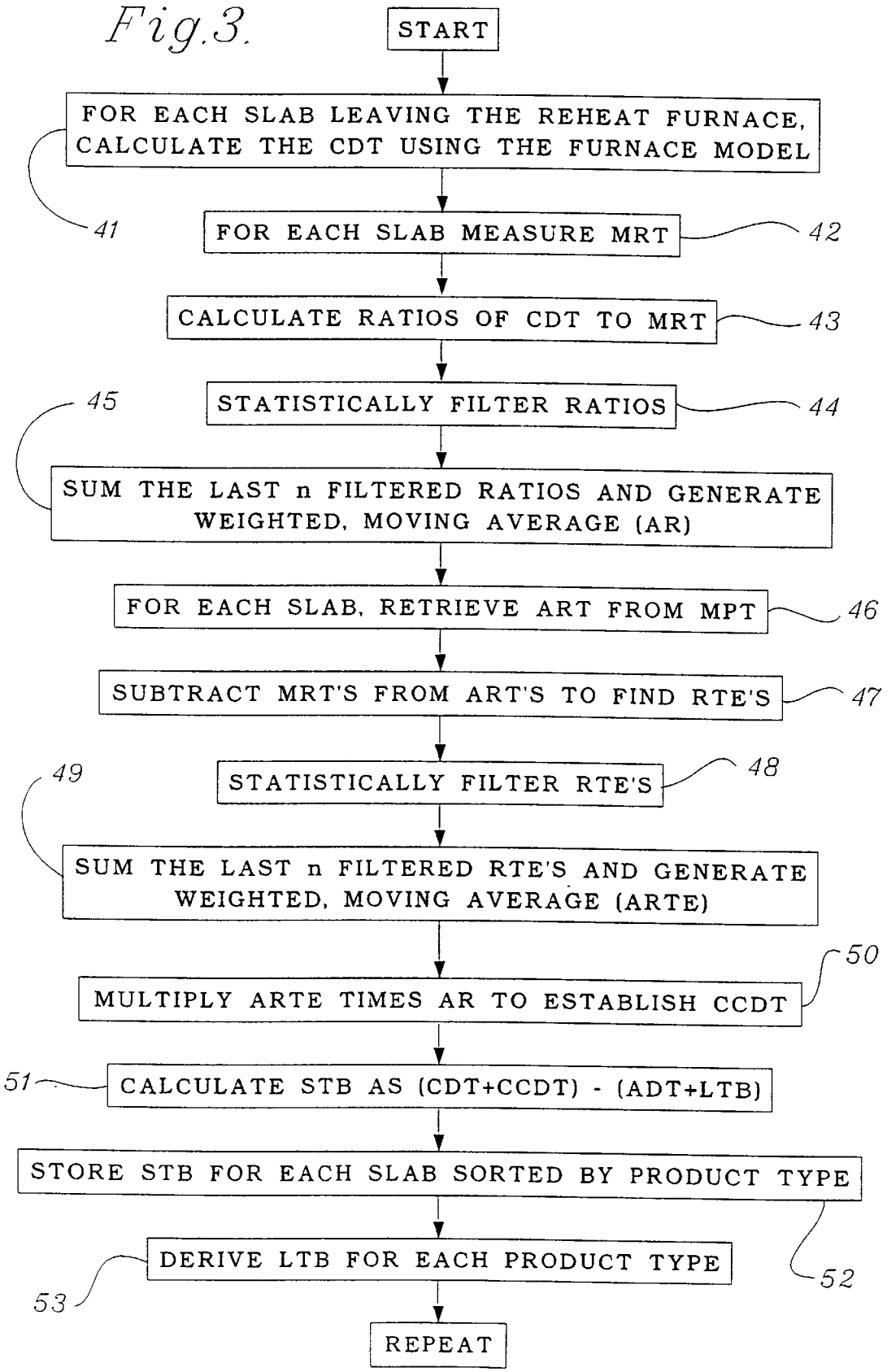
Fig.3.
START
FOR EACH SLAB LEAVING THE REHEAT FURNACE, CALCULATE THE CDT USING THE FURNACE MODEL
41
FOR EACH SLAB MEASURE MRT
42
CALCULATE RATIOS OF CDT TO MRT
43
45
STATISTICALLY FILTER RATIOS
44
SUM THE LAST n FILTERED RATIOS AND GENERATE WEIGHTED, MOVING AVERAGE (AR)
FOR EACH SLAB, RETRIEVE ART FROM MPT
46
SUBTRACT MRT'S FROM ART'S TO FIND RTE'S
47
49
STATISTICALLY FILTER RTE'S
48
SUM THE LAST n FILTERED RTE'S AND GENERATE WEIGHTED, MOVING AVERAGE (ARTE)
50
MULTIPLY ARTE TIMES AR TO ESTABLISH CCDT
51
CALCULATE STB AS (CDT+CCDT) - (ADT+LTB)
STORE STB FOR EACH SLAB SORTED BY PRODUCT TYPE
52
DERIVE LTB FOR EACH PRODUCT TYPE
53
REPEAT

ADAPTIVE CONTROL FOR REHEAT FURNACE

"This is a continuation of application Ser. No. 07/742, 770 filed on Aug. 9, 1991now abandoned"

This invention relates to the computer control of reheat furnaces in steel mills.

BACKGROUND OF THE INVENTION

This invention pertains to rolling mills for the production of metal products. An exemplary rolling mill would be a hot strip mill in which steel slabs are converted to sheet and strip products. This invention also relates to other rolling mills in which the products are, for example, plates, bars, structural shapes and rails and in which case the starting shapes are referred to as slabs, blooms, billets, etc. Usually, the output of the hot strip mill is further processed by cold rolling. The hot strip mill is preceded by a reheat furnace for raising the temperature of the slabs prior to entry into the hot strip mill. The hot strip mill is comprised of a roughing mill and a finishing mill. Control of the temperature of the slab throughout the hot rolling mill is essential. Three temperatures are considered of particular importance; the temperature of the slab as it exits the furnace, the temperature of the slab exiting from the roughing mill and the finishing temperature at the end of the finishing mill. Throughout the hot rolling process, there is a large drop in temperature. While the specific temperatures depend upon the grade and size of the product, hot rolling usually begins near 2200° F. (1200° C.) and finishes well above 1300° F. (700° C.). The function of the reheat furnace is to bring the slabs to the correct temperature to begin the hot rolling process.

Control of the reheat furnace to deliver the slabs at the desired starting temperature (herein the steel "discharge temperature") is no simple matter. It is very difficult to accurately measure the temperature of the slabs in the reheat furnace or even immediately after extraction. The slabs are covered with scale and do not have a uniform temperature through their thickness. Moreover, few mills have the luxury of continuously processing slabs of identical size and grade. These are constantly changing making control of the extract temperature more difficult. Other factors are also variable such as the rate at which the slabs are moved through the reheat furnace and the temperature of the slabs entering the reheat furnace.

Computer control has been implemented in mills for controlling the reheat furnaces, the roughing mill, and the finishing mill. Often each area has its own computer control coordinated by a central computer so that the product has the desired thickness, width and temperature. The desired or aim furnace discharge temperature (herein the "aim discharge temperature") is established so that under the expected operating conditions of the roughing mill, the slab will have a desired temperature on leaving the roughing mill (herein the "rougher exit temperature"). This invention relates to methods of improving the reliability of the discharge temperature. In other words, it relates to insuring that the actual discharge temperature (which cannot be directly measured) will result in the aim rougher exit temperature.

Mill practice tables exist for the roughing and finishing mills that establish for a given grade and size of slab and the desired finishing temperature, the aim discharge temperature and the aim rougher exit temperature. These tables are stored in the central computer, for example. Hence, as soon as a slab enters the reheat furnace on it way to the rolling mill, these aim temperatures are established by reference to the mill practice table.

To bring the slab to the aim discharge temperature, various heating zones of the reheat furnace are individually controlled. The control of the various zones to bring about the aim discharge temperature is based upon a reheat furnace model that is theoretically and empirically developed. The model is used two ways. It is used to established the desired time and temperature in each zone of the reheat furnace as the slab passes therethrough to bring about the aim discharge temperature. Because the control of the heating zones of the reheat furnace is not perfect, the model can be used to calculate or predict the discharge temperature based upon the measured conditions in each zone as the slab passes therethrough. It is practically impossible to perfectly predict the slab temperature within the furnace since conditions within and around the furnace are constantly changing. Seasons change, linings wear, gas pressures vary, thermocouples drift, etc. Moreover, the size and composition of the product may vary. These uncontrolled and unaccounted for conditions may be short-term or long-term changes that make the reheat furnace model less accurate than desired for predicting the actual discharge temperature.

Also, the conditions in the rolling mill itself may vary day to day or from operator to operator. Water sprays may be turned on or off, certain roughing mill stands may be bypassed for repair, etc. This can change what is required as an aim discharge temperature in order to achieve the aim rougher exit temperature.

The first temperature in the hot mill that can be accurately measured is the rougher exit temperature. An optical pyrometer is the usual device to measure this temperature. It has already been proposed to use a measure of this temperature to tune the operation of the reheat furnace. See "Automatic slab heating control at Inland's 80-in. hot strip mill," Veslocki et al., AISE Year Book, 1986. The procedure described therein requires the use of a roughing mill model to predict the rougher exit temperature of a slab given the discharge temperature provided by the reheat furnace model and times in the various mill stands and other measurable parameters of the roughing mill. The difference between the measured rougher exit temperature and that predicted by the roughing mill model is used as feedback for correcting the discharge temperature predicted by the reheat furnace model. This method, however, does not attempt to control an aim rougher exit temperature. It only attempts to "improve" the calculated furnace discharge temperature based upon measured rougher exit temperature and the roughing mill model. Unfortunately, roughing mill models, like all models, are subject to short and long term drift due to unmeasured parameters. As with reheat furnace models, there are many different roughing train models in use, each with its own drawbacks.

SUMMARY OF THE INVENTION

It is an advantage according to this invention to provide a system and method of fine tuning the control of reheat furnaces in a steel mill based upon the measure of the rougher exit temperature. The applicants' invention works with any reheat furnace model that is based upon an explicit predictive model of the steel temperature within the furnace and controls to a desired discharge temperature. This is a substantial advantage since numerous furnace models have been developed and applied to furnaces of different constructions. The applicants' invention also works independently of roughing mill models which is a substantial advantage since numerous roughing mill models have been developed for different roughing mills and each is subject to inaccuracies.

Briefly, according to this invention, in a steel mill comprising a reheat furnace for heating the steel, a roughing mill for reducing the steel and in most cases a finishing mill for further reducing the steel, there is provided a system and method of controlling the rolling temperature of steel at the exit of a roughing mill or just prior to the finishing mill (the rougher exit temperature). The method comprises establishing and using a mill practice table relating the aim discharge temperature of the steel from the reheat furnace and the aim rougher exit temperature of the steel for specific grades, product shapes and sizes. Mill practice tables already exist for most mills under a central computer control. The method comprises selecting or establishing a reheat furnace model for predicting the steel discharge temperature from the reheat furnace based upon grade, size, tracking information and measured temperatures in the reheat furnace. Reheat furnace models already exist for reheat furnaces under computer control. This invention contemplates the use of existing mill practice tables and existing reheat furnace models. It provides for the improved control of the rougher exit temperature by interaction with the mill practice table and the reheat furnace model.

The ratio between predicted discharge temperatures (as predicted by the reheat furnace model) and the measured rougher exit temperatures for each piece in the mill is calculated. The values of this ratio are statistically filtered based upon total time in the roughing mill. Statistical filtering comprises accumulating the times in the mill for slabs to establish a probability distribution and individual times are compared to that distribution eliminating (filtering out) rougher exit temperature values for slabs that are in the roughing mill for times at the extremes of the probability distribution. In one embodiment of this invention, a normal probability distribution is assumed and the temperature values for slabs in the mill for times outside of one standard deviation are filtered out. A weighted, moving average of the values of all ratios that pass the statistical filter is maintained. Separate weighted, moving averages are kept for each reheat furnace if multiple reheat furnaces are in use.

For each slab, the aim rougher exit temperature (as determined from the mill practice table) is compared with the measured rougher exit temperature to establish error values. The error values are statistically filtered based upon time in the mill to provide filtered error values. The same statistical filter can be used for both the temperature ratios described above and the error values. A weighted, moving average of the filtered error values is calculated for each reheat furnace.

The number of terms summed for the rolling averages of temperature ratios and error values is adjustable. Too few terms will result in overcorrection and too many will result in unresponsiveness to short-term uncontrolled deviations in operating conditions.

The filtered temperature ratio and the filtered error values are processed to establish a short-term bias to be applied to the aim discharge temperatures which are calculated to drive the error value between measured and aim rougher exit temperature to zero. The processing may simply comprise multiplication of the weighted, moving average temperature ratio times the rolling temperature average error. The short-term bias is general and does not take into account product types (grades and steel product sizes).

A historical table of short-term biases is maintained to generate long-term biases specifically related to each product type. A weighted average of the short-term biases is derived from the table for each product type.

An adjusted desired discharge temperature is established for each slab entering the reheat furnace by summing the aim discharge temperature given by the mill practice table, the current long term bias specific to that product type and furnace and the current short-term bias. The reheat furnace is then controlled according to the furnace model using the adjusted aim discharge temperature.

BRIEF DESCRIPTION OF THE DRAWINGS

FIGS. 2 and 3 are flow diagrams for the computer programs that implement the system and method according to this invention.

DESCRIPTION OF THE PREFERRED EMBODIMENTS

Figure 1:
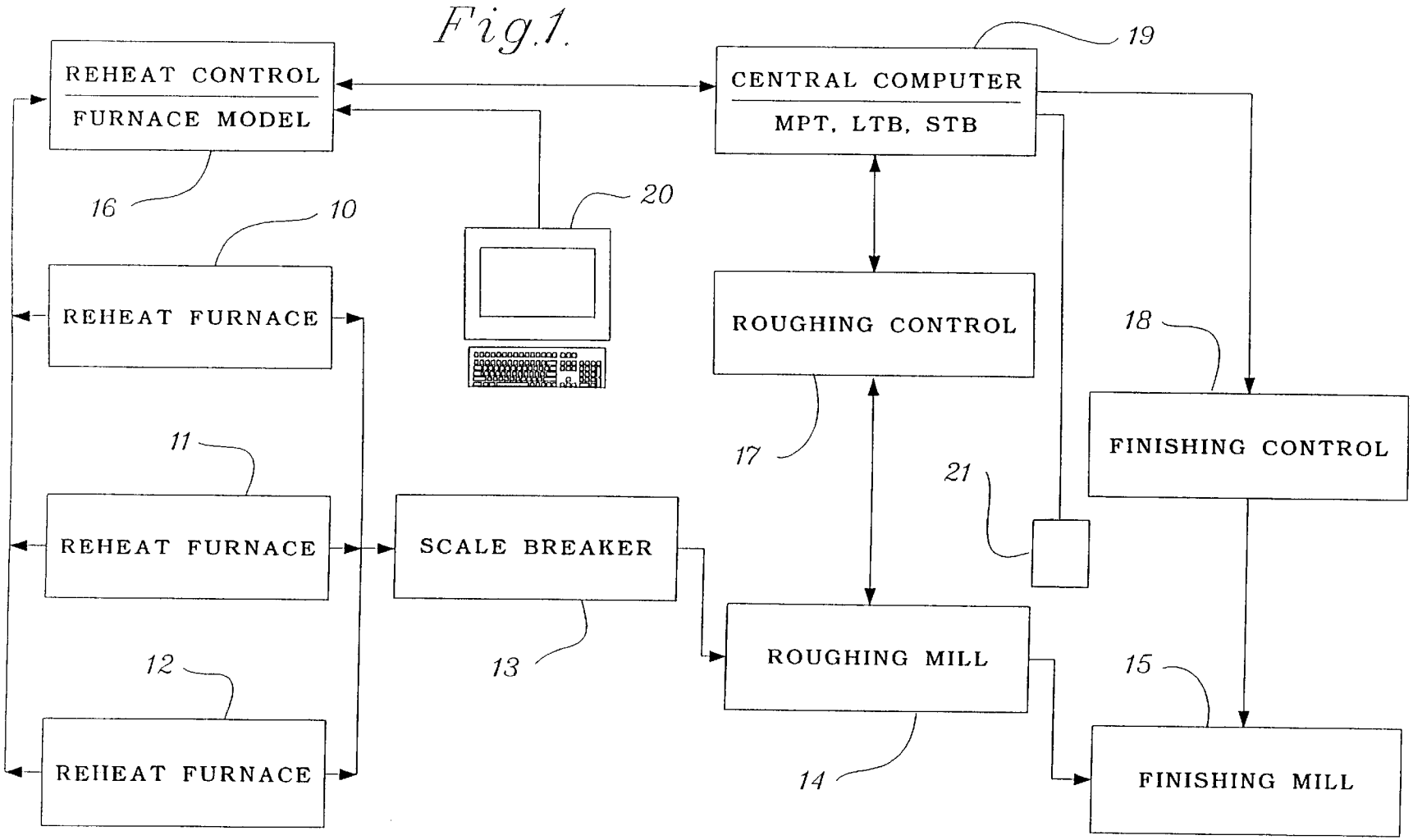
FIG. 1 is a schematic diagram of reheat furnaces, roughing and finishing mills.

Referring to FIG. 1, there is shown the functional arrangement of three reheat furnaces and hot strip mill according to a preferred embodiment of this invention. Three reheat furnaces 10, 11, and 12 receive slabs and heat them to the aim discharge temperature (ADT). The slabs are removed from the reheat furnaces and pass through scale breaker 13 where scale is removed and then to the roughing mill 14 where the initial reduction is made. The slabs emerge from the roughing mill and are passed to the finishing mill 15. The measured rougher exit temperature (MRT) is sensed at the it end of the roughing mill by an optical pyrometer 21, for example. The reheat furnaces are controlled by a reheat furnace control computer which controls the various zones of the furnace using a reheat furnace model. The roughing mill and finishing mill may also be controlled by computers 17 and 18. The entire hot strip mill operation may be controlled by the central computer 19. Undoubtedly, one or more of the distributed computers 16, 17, and 18 could be combined with each other or the central computer. The existence of computers 17, 18 and 19 is not essential to this process.

A terminals 20 for the entry of slab data is connected to the reheat control computer 16. The computer programs for the reheat control computer based upon a reheat furnace model are known as also are the programs for the roughing mill control and the finishing mill control. The details of these programs form no part of this invention.

According to the embodiment of this invention being described, the central computer or possibly the reheat furnace control computer has stored therein the mill process table (MPT) which includes among other information the aim discharge temperature (ADT) and the aim rougher exit temperature (ART) for each product type. Typically, these have been established by experience over a number of years. Each mill has its own mill practice table.

Figure 2:
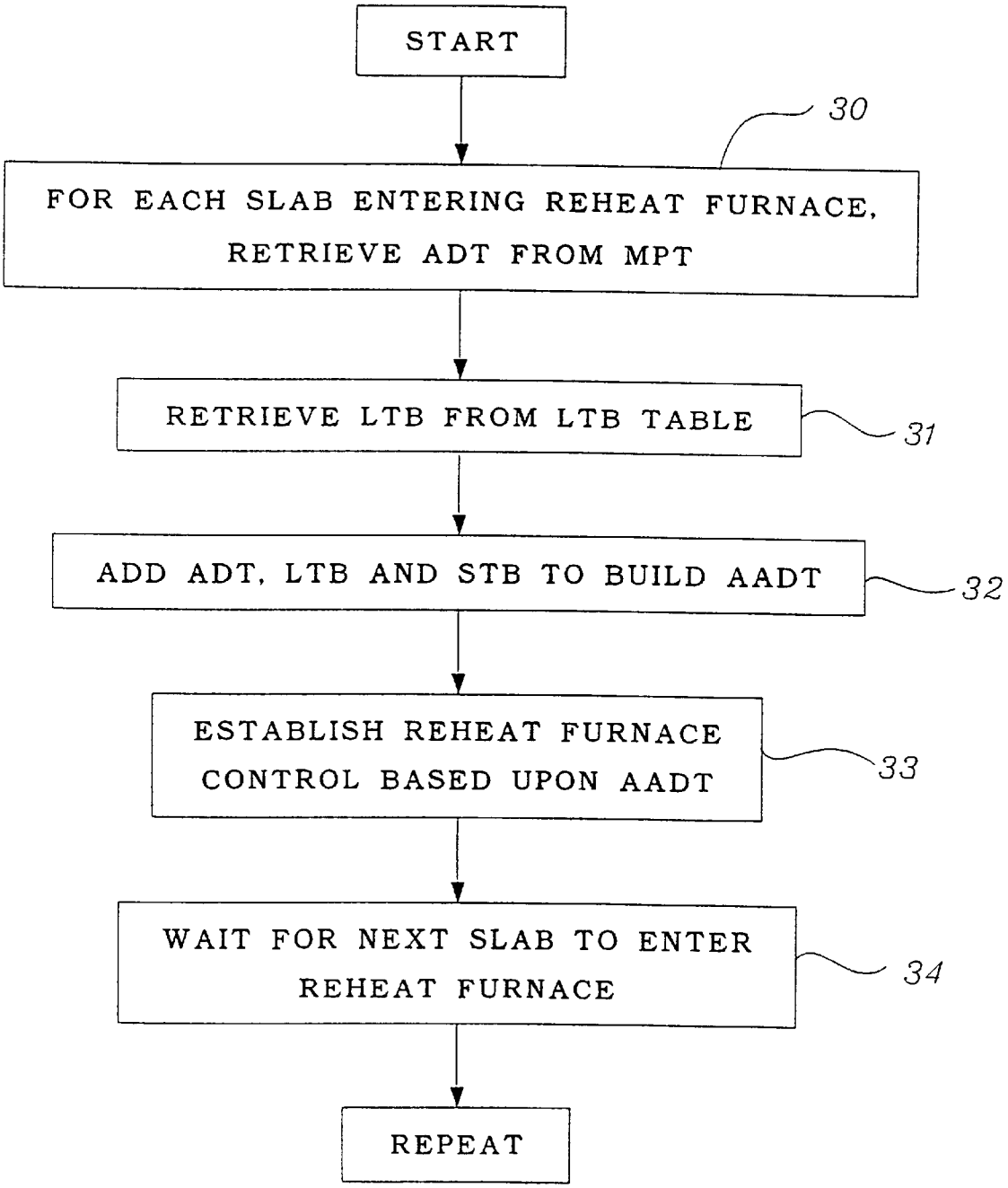

The system and methods according to this embodiment are implemented by stored computer programs. Referring to FIG. 2, there is shown a flow diagram of one portion of the programs. For each slab entering a reheat furnace, the aim discharge temperature (ADT) is retrieved from the mill practice table at 30. The product types (grade, size, etc.) are manually entered by an operator at terminal 20 and are used to locate the appropriate ADT for the slab in the mill practice table. If the production of slabs is computer controlled, the slab data may be entered from that system.

In prior art computer controlled mills, the ADT would be passed to the reheat furnace model to control the zones of the reheat furnace as the slab passes therethrough. According to this invention, a long-term bias (LTB) is retrieved from the LTB table at 31 and added along with a short-term bias (STB) to the ADT to build the adjusted aim discharge temperature (AADT) at 32 which is then passed to the reheat furnace model at 33. This computer loop then waits at 34 until the next slab enters a reheat furnace. Preferably, the long-term bias table is a plurality of tables, one for each reheat furnace.

The computer program for establishing the STB and the values in the LTB table is shown in flow diagram form in FIG. 3. Since there are many slabs being processed at the same time through the reheat furnaces and the roughing mill, the program must keep track of each, and various steps of the program are jumped to in response to the movement of individual slabs past certain positions. For any one slab, the program steps shown in FIG. 3 are taken in order, but because multiple slabs are being processed, steps pertinent to other slabs may be interleaved with those relating to a given slab. For each slab leaving a reheat furnace, the reheat model is used to determine the calculated discharge temperature (CDT) at 41. This calculation may be performed by a call to the reheat control 16 where the reheat model resides. The reheat model takes the information about the slab and the zone conditions as the slab passes through the reheat furnace to calculate or predict the steel temperatures along the furnace length including the discharge temperature. The furnace control model takes the calculated temperature information about the slab and the adjusted aim discharge temperature to establish the firing conditions in the various zones of the reheat furnace.

As each slab exits from the roughing mill, the slab temperature, i.e., the measured rougher exit temperature (MRT), is measured and automatically input at 42. This temperature is the first temperature of the slab that can be accurately and repeatably measured following its entry into the reheat furnace. For each slab, the ratio of the CDT to MRT is calculated at 43. The ratios are then applied to a statistical filter at 44. Statistical filtering comprises accumulating the times in the mill for slabs to establish a probability distribution of time in the mill. Individual times are compared to that distribution eliminating (filtering out) CDT/MRT ratio values for slabs that were in the roughing mill for times at the extremes of the probability distribution. In one embodiment of this invention, a normal probability distribution is assumed and the temperature values for slabs in the mill for times outside of one standard deviation are filtered out.

A weighted, moving average of the filtered ratios (AR) is calculated at 45. The number of values averaged in the weighted, moving average may be adjusted as described above.

The weighted, moving average is calculated so that the most recent slab values have the greatest effect on the weighted average. While using a weighted, moving average is preferred, applications of this invention may exist wherein a simple moving average will suffice.

For each slab, the ART is retrieved at 46 and compared to the MRT for that slab at 47. The difference is the rougher exit temperature error (RTE). These errors are statistically filtered according to time of the slab in the roughing mill at 48. The same filters used for the ratios of CDT to MRT may be used.

A weighted, moving average of the filtered rougher exit temperature errors ARTE is calculated at 49.

The number of values averaged in the weighted, moving average may be adjusted as described above.

The ARTE is multiplied by the AR at 50 to determine the change to the current calculated discharge temperature (CCDT) required in order to achieve the aim rougher exit temperature.

In an especially preferred embodiment, the weighted, moving averages AR and ARTE are used for calculating the change to the current calculated discharge temperature CCDT. The AR and ARTE values are used directly only if the last ratio CDT/MRT and the last difference (ART-MRT) did not pass through the filter. If the AR and ARTE values are not used then the CCDT is calculated directly as CDT/MRT times (ART-MRT). Otherwise, the AR and ARTE values are weighted and averaged with the last CDT/MRT and (ART-MRT) to obtain the CCDT. This will increase the responsiveness of the control process.

The short-term bias (STB) is then determined at 51 to be the difference between this required furnace discharge temperature (CDT+CCDT) and the current tabulated aim discharge temperature (ADT) corrected by the long-term bias (LTB) to be explained. In the method according to this invention, it is generally assumed that the CET is correct and that the CET varies from the AET only because of uncontrolled or unaccounted for furnace conditions. For example, if the furnace is pushed too fast, it may not be possible to obtain the AET. Thus, the difference between the AET and CET is taken into account when generating the short-term bias. When the furnace returns to the normal push rate at which the AET can be obtained, a disruptive STB will not have been established.

At 52, the history of the short-term biases for each product type is maintained over a long period and a weighted average is calculated to establish a long-term bias (LTB) for that product. The mill practice table can be modified by adding in the long-term bias to the value in the table and setting the long-term bias to zero or it can be maintained in a separate, parallel table of long-term biases. In the case of modifying the mill practice table, it may be necessary to establish a mill practice table for each furnace.

The above-described system has been installed in a working mill and found to provide excellent control of the rougher exit temperature. No special knowledge of the particular rolling mill model employed or the roughing mill model was required. Indeed, the system was installed to replace an attempted adaptive control system wherein a calculated rougher exit temperature based upon a roughing mill model was compared to the measured transfer temperature.

Having thus defined our invention with the detail and particularity required by the Patent Laws, what is desired protected by Letters Patent is set forth in the following claims.

We claim:

1. In a mill comprising a reheat furnace for heating workpieces, a method of controlling the reheat furnace to deliver workpieces at an aim discharge temperature which is continuously, dynamically modified to achieve an aim rolling temperature comprising the steps of:

establishing an initial aim discharge temperature for each workpiece, wherein said initial aim discharge temperature is an initial estimate of said aim discharge temperature required to achieve said aim rolling temperature;

calculating the reheat furnace discharge temperature for a workpiece leaving the reheat furnace based upon a reheat furnace model, wherein said calculation of a reheat furnace discharge temperature is repeated for each workpiece leaving the reheat furnace;

modifying furnace conditions to drive said calculated discharge temperature to said aim discharge temperature;

measuring a temperature of the workpiece in a rolling mill receiving the output of the reheat furnace, wherein said measuring of the workpiece temperature is repeated for each workpiece passing through the rolling mill;

determining a ratio between said calculated reheat furnace discharge temperatures and said measured temperatures of the workpieces in the rolling mill receiving the output of the reheat furnace;

statistically filtering said ratios to remove extreme values of said ratios based upon time in the rolling mill to provide filtered ratios;

generating a moving average of said filtered ratios to provide a current filtered relationship between said calculated discharge temperatures and said measured temperatures;

comparing aim temperatures with said measured temperatures of workpieces in the rolling mill to establish error values;

statistically filtering said error values to remove extreme values of said error values based upon time in the mill to provide filtered error values;

generating a moving average of said filtered error values;

determining a short-term bias to said aim discharge temperature as a function of said filter error values and said filtered ratios;

modifying said aim discharge temperature based upon said short-term bias; and modifying conditions in the reheat furnace based upon said modified aim discharge temperature to drive said calculated discharge temperature to said modified aim discharge temperature.

2. A method according to claim 1 further comprising the step of generating long-term biases specifically related to product types based upon a historical table of short-term biases.

3. A method according to claim 2 further comprising establishing said modified aim discharge temperature by summing said aim discharge temperature, said long-term bias and said short-term bias.

4. In a steel mill comprising a reheat furnace for heating the steel pieces and a rolling mill for reducing the steel pieces, a method of controlling the rolling temperature of the steel pieces at a position in the rolling mill by continuously, dynamically modifying conditions in the reheat furnace comprising the steps of:

selecting from a mill practice table relating an initial aim discharge temperature of the steel pieces from the reheat furnace and an aim temperature of the steel pieces in the rolling mill for specific grades, product shapes and sizes;

using a reheat furnace model for calculating a calculated discharge temperature from the reheat furnace of a steel piece based upon grade, size, tracking information and measured temperatures in the reheat furnace, wherein said calculation of a reheat furnace discharge temperature is repeated for each steel piece leaving the reheat furnace;

modifying furnace conditions to drive said calculated discharge temperature to said aim discharge temperature;

measuring a temperature of the steel piece in the rolling mill, wherein said measuring of the steel piece temperature is repeated for each steel piece passing through the rolling mill;

determining a ratio between said calculated discharge temperatures from the reheat furnace and said measured rolling mill temperatures for steel pieces in the mill;

statistically filtering said ratios to remove extreme values of said ratios based upon time in the rolling mill to provide filtered ratios;

generating a moving average of said filtered ratios to provide a current filtered relationship between said calculated discharge temperatures and said measured rolling mill temperatures;

comparing said aim rolling mill temperatures with said measured rolling mill temperatures of pieces in the mill to establish error values;

statistically filtering said error values to remove extreme values of said error values based upon time in the mill to provide filtered error values;

generating a moving average of said filtered error values;

determining a short-term bias to said aim discharge temperatures as a function of said filtered error values and said filtered ratios;

maintaining a historical table of short-term biases;

generating long-term biases specifically related to product types based upon said tables of short-term biases;

adjusting said aim discharge temperature by summing said aim discharge temperature given by the mill practice table, said long-term bias and said short-term bias; and controlling conditions in the reheat furnace according to the furnace model and said adjusted aim discharge temperature to drive said calculated discharge temperature to said adjusted aim discharge temperature.

5. In a steel mill comprising a reheat furnace for heating the steel pieces, a roughing mill for reducing the steel and a finishing mill for further reducing the steel pieces, a method of controlling the rolling temperature of steel at the exit of a roughing mill by continuously, dynamically modifying conditions within the reheat furnace comprising the steps of:

using a mill practice table relating an aim discharge temperature of the steel from the reheat furnace and an aim discharge temperature of the steel exiting the roughing mill for specific grades, product shapes and sizes to select an initial aim discharge temperature and an aim roughing mill temperature;

using a reheat furnace model for calculating a calculated discharge temperature from the reheat furnace based upon grade, size, tracking information and measured temperatures in the reheat furnace, wherein said calculation of a reheat furnace discharge temperature is repeated for each steel piece leaving the reheat furnace;

modifying furnace conditions to drive said calculated discharge temperature to said aim discharge temperature;

measuring a temperature of the steel piece in the roughing mill, wherein said measuring of the steel piece temperature is repeated for each steel piece exiting the roughing mill;

determining a ratio between said calculated discharge temperatures from the reheat furnace and said measured rougher exit temperatures for each steel piece in the mill;

statistically filtering said ratios to remove extreme values of said ratios based upon time in the roughing mill to provide filtered ratios;

generating a moving average of said filtered ratios to provide a current filtered relationship between said calculated discharge temperatures and said measured rougher exit temperatures;

comparing said aim temperatures of steel pieces exiting the mill with said measured rougher exit temperature to establish error values;

statistically filtering said error values to remove extreme values of said error values based upon time in the mill to provide filtered error values;

generating a moving average of said filtered error values;

determining a short-term bias to said aim discharge temperatures as a function of said filtered error values and said filtered ratios;

maintaining a historical table of said short-term biases;

generating long-term biases specifically related to product types based upon said tables of short-term biases;

adjusting said aim discharge temperature by summing said aim discharge temperature given by the mill practice table, said long-term bias and said short-term bias; and controlling conditions in the reheat furnace according to the furnace model and said adjusted aim discharge temperature to drive said calculated discharge temperature to said adjusted aim discharge temperature.

6. The method according to claim 1, wherein said short-term bias is established by multiplying a filtered ratio value times a filtered error value.

7. The method according to claim 6 wherein one or both values are average values.

8. The method according to claim 1, wherein said short-term bias is established by multiplying a filtered ratio value times a filtered error value and adding thereto a difference between said calculated discharge and said aim discharge temperatures.

9. The method according to claim 8 wherein one or both values are averaged values.

10. The method according to claim 4 wherein said short-term bias is established by multiplying a filtered ratio value times a filtered error value.

11. The method according to claim 10 wherein one or both values are average values.

12. The method according to claim 5 wherein said short-term bias is established by multiplying a filtered ratio value times a filtered error value.

13. The method according to claim 12 wherein one or both values are average values.

14. The method according to claim 4 wherein said short-term bias is established by multiplying a filtered ratio value times a filtered error value and adding thereto a difference between said calculated discharge and said aim discharge temperatures.

15. The method according to claim 14 wherein one or both values are average values.

16. The method according to claim 5 wherein said short-term bias is established by multiplying a filtered ratio value times a filtered error value and adding thereto a difference between said calculated discharge and said aim discharge temperatures.

17. The method according to claim 16 wherein one or both values are average values.

* * * * *